United States Patent [19]

Gleason et al.

[11] 4,167,139

[45] Sep. 11, 1979

[54] TIME DELAY PRIMER AND METHOD OF USING SAME

[75] Inventors: David M. Gleason, Chagrin Falls; Robert V. Vickers, Shaker Heights, both of Ohio

[73] Assignee: Austin Powder Company, Beachwood, Ohio

[21] Appl. No.: 799,463

[22] Filed: May 23, 1977

[51] Int. Cl.[2] ..... F42B 3/10; F42C 1/04

[52] U.S. Cl. ..... 102/24 R; 102/23; 102/27 R

[58] Field of Search ..... 102/22–24 R, 102/27 R

[56] References Cited

U.S. PATENT DOCUMENTS

| | | | |
|---|---|---|---|
| 2,736,263 | 2/1956 | Lewis et al. | 102/27 R |
| 2,913,982 | 11/1959 | Hayes | 102/24 R |
| 4,060,033 | 11/1977 | Postupack et al. | 102/27 R |
| 4,060,034 | 11/1977 | Bowman | 102/27 R |

FOREIGN PATENT DOCUMENTS

| | | | |
|---|---|---|---|
| 663864 | 5/1963 | Canada | 102/24 R |

*Primary Examiner*—Verlin R. Pendegrass
*Attorney, Agent, or Firm*—Meyer, Tilberry & Body

[57] ABSTRACT

A delay primer unit for detonating an explosive material in a borehole with a detonating cord down line extending into the borehole wherein the unit comprises an explosive element capable of detonating the explosive material upon being detonated, means for preventing direct detonation of the explosive element by the down line and an elongated, flexible time delay detonation element having a first end slidably connected to the down line and a second end connected in detonation relationship with the explosive element and generally movable with respect to the first end. The delay element is used to mount the explosive element on the down line.

7 Claims, 10 Drawing Figures

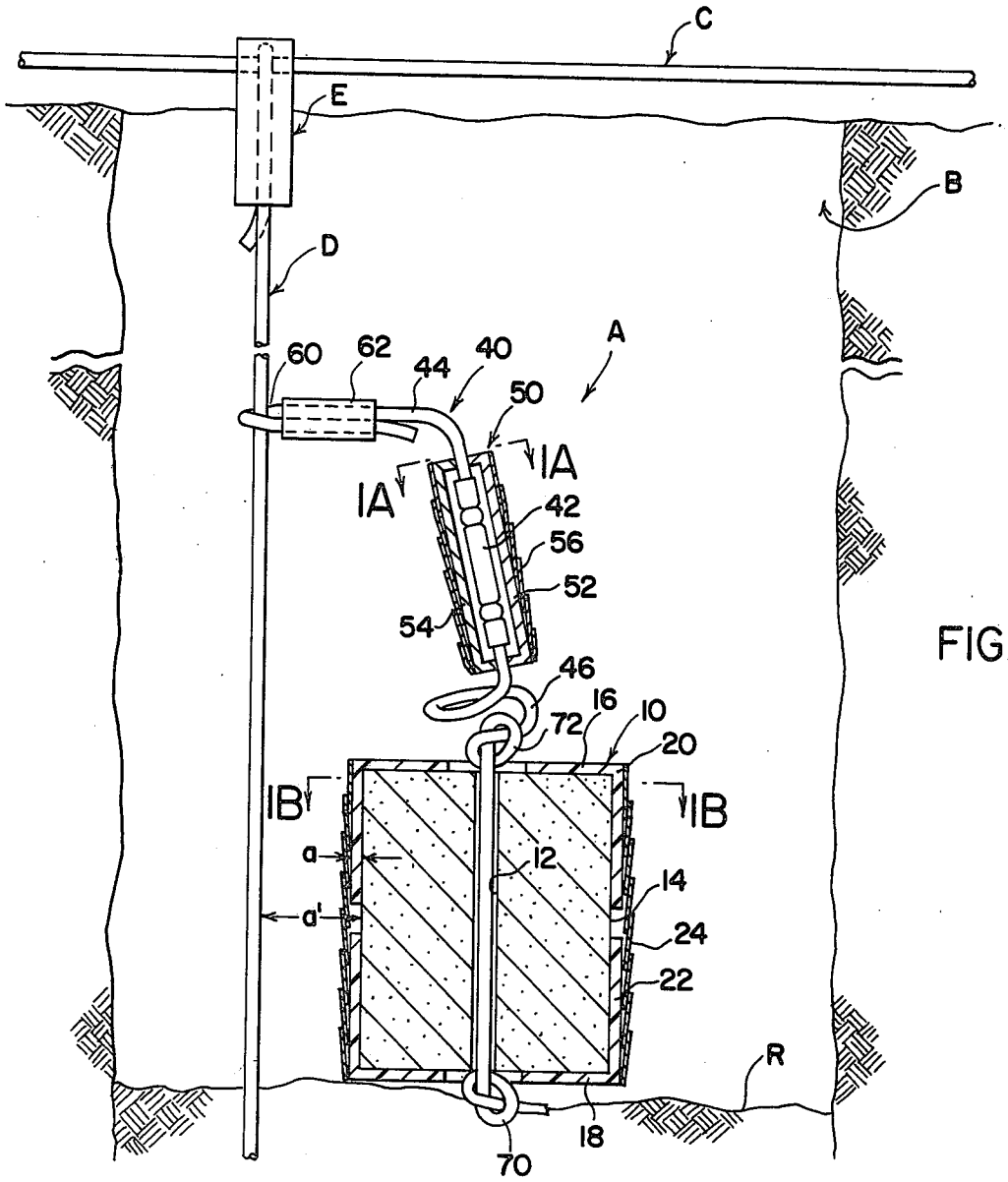
FIG. 1
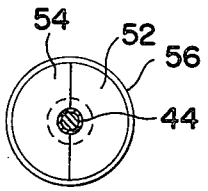
FIG. IA
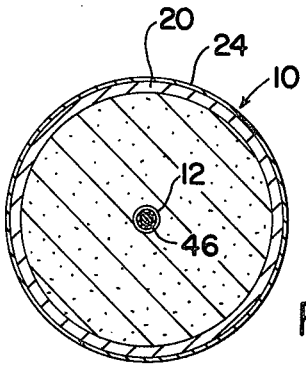
FIG. IB $\frac{X}{20} \ll TD_1 \ll TD_2 \ll TD_3$ $T_1 \doteq \frac{X}{20} \doteq ZERO$ $T_2 \doteq \frac{X}{20} + 25ms \doteq 25ms$ $T_3 \doteq \frac{X}{20} + 100ms \doteq 100ms$ $T_4 \doteq \frac{X}{20} + 175ms \doteq 175ms$

TIME DELAY PRIMER AND METHOD OF USING SAME

The present invention relates to the art of charging a borehole preparatory to detonation and more particularly to an improved time delay primer unit and the method of using the same.

BACKGROUND OF INVENTION

In using explosives to dislodge or heave material such as in a quarry, it is quite common practice to drill a number of boreholes, charge the boreholes with explosive material, such as ANFO or ammonium nitrate slurry, and then detonate the explosive material in the boreholes in sequence to produce the desired movement of material. Since material of the type used in boreholes generally requires an intermediate primer of high explosive material for detonation, various arrangements have been used for priming the boreholes for detonation.

A common arrangement is to secure a detonating cord through the normal opening in a primer and drop the primer and cord to the lower portion of the borehole. Thereafter, explosive material is placed into the borehole or the borehole is filled further with explosive material. In some instances, the borehole is provided with several sections of explosive material separated by non-explosive material, such as soil. In these instances, a primer is generally required for each of the separate explosive charges. To accomplish this, as each section of charged explosive material is deposited, a primer is dropped down along the detonating cord forming the down line. After several charges are in place and primed, the same detonating cord can be used to explode all the primers simultaneously. This simultaneously explodes each of the various explosive charges within the borehole to provide maximum heave of the material being moved. These concepts of charging and priming boreholes with standard, available primers are well known and extensively used in the field.

In some instances, maximum earth movement can be accomplished by exploding or detonating various boreholes at different intervals during a single detonation. To accomplish this, the trunk lines used to detonate several detonating cords of different boreholes are interconnected by time delay devices. Thus, one group of boreholes controlled by one trunk line can be detonated at a slightly different time than another group of boreholes connected to a separate trunk line. These time delay connections take a variety of forms. Most commonly, they involve a time delay cartridge which is generally cylindrical and has internal structure which delays the propagation of a detonation wave therethrough for a preselected time. These cartridges are often connected at opposite ends to a relatively short section of commercial detonating cord. Thus, to interconnect two trunk lines for different detonating times, one of the time delay detonating cord sections is secured to one trunk line and the other detonating cord section is secured to the other trunk line. During detonation of one trunk line, there is a time delay until detonation of the next trunk line. Also, there are one piece molded time delay couplings which can be connected between somewhat standard detonating cords to provide the same preselected time delay. These cartridges or couplings are well known in the art and can be timed for delays of approximately 5 milliseconds to upwardly of several seconds. Indeed, some time delays are rated at zero time delays and they are often used for a connection between a primer and a low energy type of detonating cord, such as a detonating cord having a grain loading of less than about 10 grains per linear foot. Also, such zero time delay devices can be used with low energy detonating cord of the type having a hollow tube with an inner cylindrical wall coated by explosive material or filled with a combustible gas. In all instances, the time delay devices provide a preselected time shift from the somewhat instantaneous detonation occurring in a detonating cord. The availability and use of these various time delay devices used with detonating cords are well known. In addition, some time delay devices may be used with electrical caps which can be used to explode the high explosive of a primer for detonating the charge in a borehole at a preselected time after an electrical signal.

In recent years, governmental regulations have been adopted which affect the use of explosives of the type described above. One of these regulations, which is becoming quite common, limits the amount of explosive material which can be detonated at any given time within a certain distance from an inhabited building or from a highway or public transportation artery. This regulation has caused certain modifications in the blasting techniques used in congested areas or in areas adjacent specific structures. Compliance with these regulations has resulted in the adoption of the concept of detonating the material in a borehole at different times to prevent a violation of regulations regarding the amount of explosives that can be detonated at any given time. The first attempt to provide a means of detonating several axially spaced explosive charges in a given borehole at different and distinct times has been the use of separate time delay electrical caps for detonating the primer in each of the different axially spaced explosive charges in a single borehole. This procedure involved the conversion of the detonating system into an electrical system. As is well known, there are certain environments in which an electrical system is not acceptable or completely satisfactory, for instance, when electrical equipment is being used in the vicinity or during electrical storms. When electrical lines are laid for a detonation, these lines can act as an antenna and can be actuated in some unusual situations by electromagnetic waves, such as radio waves. Also, many users are well accustomed to detonating cord and somewhat hesitate to replace such systems with electrical systems to comply with governmental regulations. Thus, there is a substantial amount of effort devoted to the modification of the detonating cord system into a system which will comply with regulations and provide sequential detonation of separate charges axially spaced within a single borehole. One of the most common systems is to provide a separate time delay cartridge in the detonating cord extending to each of several primers within the borehole. This requires the use of separate and distinct down lines extending to the different primers at axially spaced positions within the borehole. This type of arrangement is time consuming and costly. Another arrangement is to provide time delay cartridges at the primers themselves and use several low energy detonating cords extending from the upper trunk line to the separate primers within a given borehole. This concept is not substantially different from the concept of using time delay devices in the down line itself since separate and distinct down lines are required for each primer to produce the time delay required for sequential detonation of the axially spaced charges.

In prior U.S. application Ser. No. 740,799, filed Nov. 11, 1976, there is described an improvement wherein a borehole having spaced explosive charges may be primed to detonate at various spaced times to provide a desired explosion of the various spaced charges in the borehole. In the disclosed preferred embodiment of the invention of the prior application, the explosive element is supported on a carrier which slides along a detonating cord down line into the borehole. A time delay element is mounted on the carrier and is connected between the down line and the primer or explosive charge. This system as broadly disclosed in prior application and as specifically shown, is becoming widely accepted for time delay detonation of spaced charges in boreholes. However, the specific embodiment of the prior application utilizes a plastic carrier which adds to the cost of the operation and in many instances requires the use of a primer cast with the carrier. The present invention relates to an improvement utilizing the broad concept of the prior application but without requiring certain disadvantages associated with the disclosed preferred embodiment in the prior application.

THE INVENTION

In accordance with the present invention, there is provided a time delay primer unit for detonating an explosive material in a borehole with a detonating cord down line extending into the borehole which unit comprises an explosive element capable of detonating the explosive material and means for preventing direct detonation of the explosive element by the down line. As so far described, the present invention relates to the broad concept disclosed in prior application Ser. No. 740,799 filed Nov. 11, 1976, and incorporated by reference herein as background information. In accordance with the present invention, there is provided an elongated, flexible time delay detonation element having a first end slidably connected to the down line and a second end connected in detonation relationship with the explosive element and generally movable with respect to the first end so that the explosive element or primer is, in effect, connected to the down line only by a slidable connection of the time delay element.

In accordance with a more limited aspect of the invention, the primer incorporates a detonation insulating barrier to cause detonation by the time delay element and not by detonation of the down line.

The primary object of the present invention is the provision of a time delay primer, which primer is inexpensive to produce and easy to use in the field.

Another object of the present invention is the provision of a method for using the improved time delay primer as described above.

Still another object of the present invention is the provision of a method of priming an area of a borehole, which method uses a primer slidably connected to a down line only by a time delay element or device.

Still a further object of the present invention is the provision of a delay primer unit, which unit may be slidably mounted onto the down line of a borehole without passing the down line through the primer on a structure fixed thereto.

These and other objects and advantages will become apparent from the following description taken together with the drawings incorporated herewith.

BRIEF DESCRIPTION OF DRAWINGS

The present invention is illustrated in the accompanying drawings in which:

FIG. 1 is a side elevational view, partially cross-sectioned, showing the preferred embodiment of the present invention;

FIG. 1A is an enlarged view taken generally along line 1A—1A of FIG. 1;

FIG. 1B is a cross-sectional view taken generally along line 1B—1B of FIG. 1;

PREFERRED EMBODIMENT

Figure 2A:
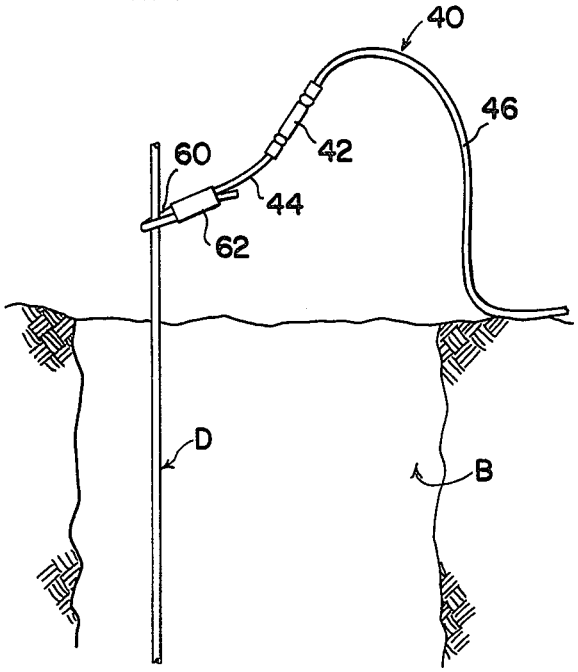
FIGS. 2A–2D are a series of side elevational views showing the sequence of a method employing the delayed primer as shown in FIG. 1.

Referring now to the drawings wherein the showings are for the purpose of illustrating preferred embodiments of the invention only and not for the purpose of limiting same, FIG. 1 shows a time delay primer A constructed in accordance with the present invention for use in a borehole B adjacent to which passes a trunk line C formed from a standard detonating cord of the type generally having a loading of 30–60 grains per foot. The material may be PETN or the like. Extending into borehole B there is a somewhat standard down line D also formed from a detonating cord usually of the type used in trunk line C and coupled to the trunk line by an appropriate coupling, such as a knot or a standard plastic coupling E. Referring now to the delay primer A it includes a somewhat standard cast primer 10 of the type which can be detonated by a detonating cord, such as that used in down line D, and which is sufficiently powerful to cause detonation of the explosive material being used in borehole B. The explosive material is not detonated by detonating cord of the type used in the down line, but is detonated by a cast primer. The primer, in turn, is detonated by a detonating cord forming down line D. In some instances, down line D is formed from a low energy detonating cord which may require an intermediate detonating element between the down line and primer 10. Primer 10 includes a center bore 12 generally coaxial with outer cylindrical surface 14 and extending between a first side 16 and a second side 18. Of course, primer 10 could have a variety of different shapes. To prevent direct detonation of primer 10 by down line D, there is provided a detonation insulating barrier means formed from two generally similar plastic cups 20, 22 telescoped over surface 14 at sides 16, 18. These cups are held together by an appropriate arrangement, such as wrapped tape 24. The tape and cups have a thickness generally exceeding the thickness a of the cups, which thickness is sufficient to prevent detonation of primer 10 by down line D. Under normal circumstances, primer 10 is spaced from detonating cord D a distance a′ which is always greater than the distance a necessary to prevent detonation of primer 10 by the down line. These relative distances are representative in nature to show the concept that primer 10 has an arrangement for preventing direct detonation between the down line and the primer. Other arrangements could be used for providing the insulating barrier and for preventing detonation directly from down line D.

Primer 10 is connected to down line D by an intermediate, flexible detonation time delay element 40 which is a standard time delay element having a delay cartridge 42, a first length of detonating cord 44 and a second length of detonating cord 46. Detonating cord or length 44 forms a first or input end of the time delay element whereas the second length 46 of cord forms the output or second end of the detonating time delay element 40. This element is essentially elongated, flexible and the ends 44, 46 are not generally secured in a fixed relationship. End 46 can move substantially with respect to end 44. In this manner, element 40 can hang or connect primer 10 onto down line D for sliding movement without an intermediate carrier or support means holding the time delay element and primer in fixed spatial relationship. Without mounting the primer directly onto the down line, element 40 supports primer 10. In practice, the standard time delay cartridge 42 can have any of several time delay functions or values, which may extend from a few milliseconds, such as five milliseconds to several seconds. To insulate and protect the time delay cartridge 42 from cord D there is provided a barrier means 50 formed from cups 52, 54 held around cartridge 42 by an appropriate means, such as wrapped tape 56. Of course, this barrier may not be required by an appropriate adjustment of the lengths of cord 44, 46 and other geometries relating to the preferred embodiment as shown in FIG. 1.

First end or length 44 of detonating cord, which may be detonating cord loaded between 30–60 grains per foot or other appropriate detonating cord, is slidably secured or fastened onto down line D. This can be done by forming a loop or bight 60 with an appropriate cord clip or coupling 62. This coupling receives two lengths of detonating cord and holds the lengths in place with loop 60 slidably engaging down line D in detonation transfer relationship. Any appropriate arrangement could be used for connecting primer 10 onto the output side of time delay cartridge 42. In the illustrated embodiment, cord length 46 is tied into knots 70, 72 which hold second length 46 of detonating cord through bore 12 in detonating relationship with primer 10. In practice, detonating cord forming ends 44, 46 includes a central core of explosive material and a layer of supporting material surrounding the core as shown in FIGS. 1A, 1B. This is standard cord construction in the explosive art.

Figure 2B:
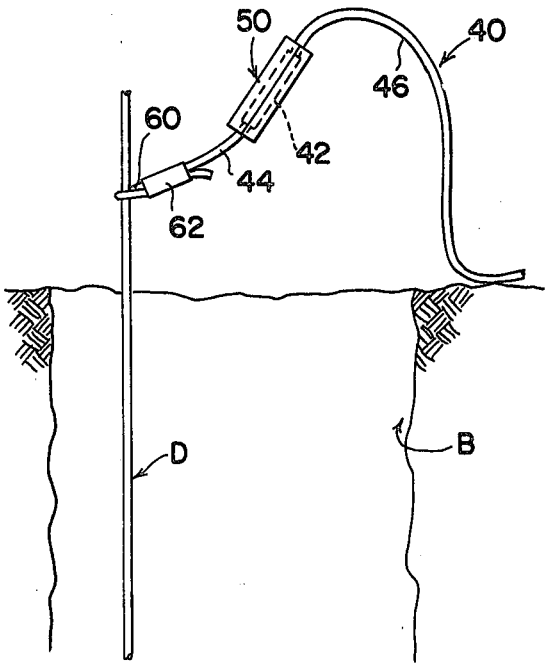
Figure 2C:
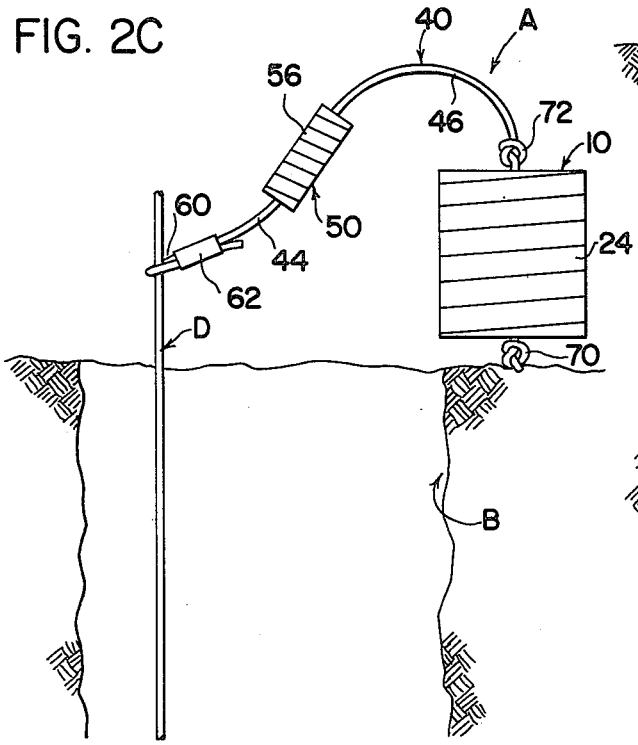
Figure 2D:
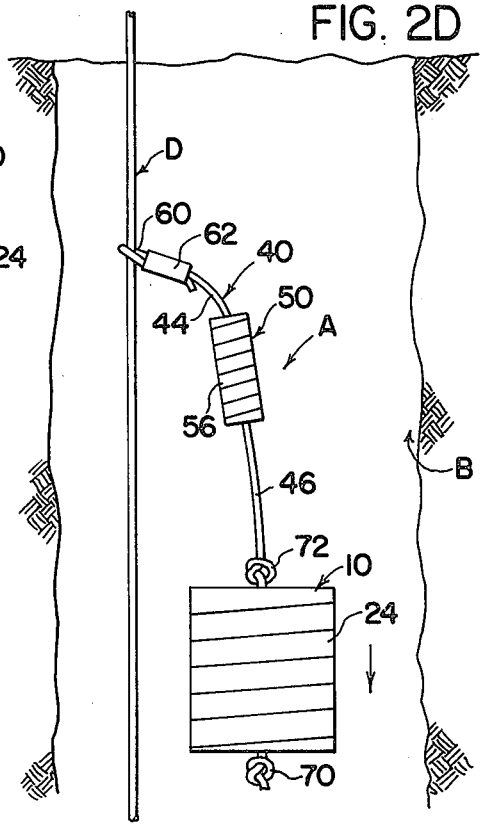

As best shown in FIGS. 2A–2D, first end 44 of time delay element 40 is looped around down line D and fastened together by coupling 62. In this manner, the time delay element is slidable axially along down line D into borehole B. This operation is illustrated in FIG. 2A. In FIG. 2B, the barrier 50 is positioned around time delay cartridge 42, if needed, and tape 56 is wrapped around this barrier as shown in FIG. 2C. Thereafter, knot 72 is formed in second length 46 of detonating cord. An extended length of end 46 is then passed through bore 12 of primer 10 and tied at the lower end or side with a knot 70, as shown in FIG. 2C. This completes the assembly of the time delay primer unit A. Thereafter, as shown in FIG. 2D, primer 10 is dropped into borehole B where it pulls the time delay element 40 along the detonating cord forming down line D. This assembly then comes to rest against a barrier R formed from soil or other dividing material, as shown in FIG. 1. Consequently, detonation of down line D substantially, instantaneously detonates first cord length 44. After a time delay determined by selection of cartridge 42, second end 46 of detonating cord detonates primer 10. This detonates explosive material charged around primer 10 and above barrier or wall R. Thus, the explosive material above barrier R, as shown in FIG. 1, is exploded at a preselected time delay after somewhat instantaneous detonation of down line D.

Figure 3:
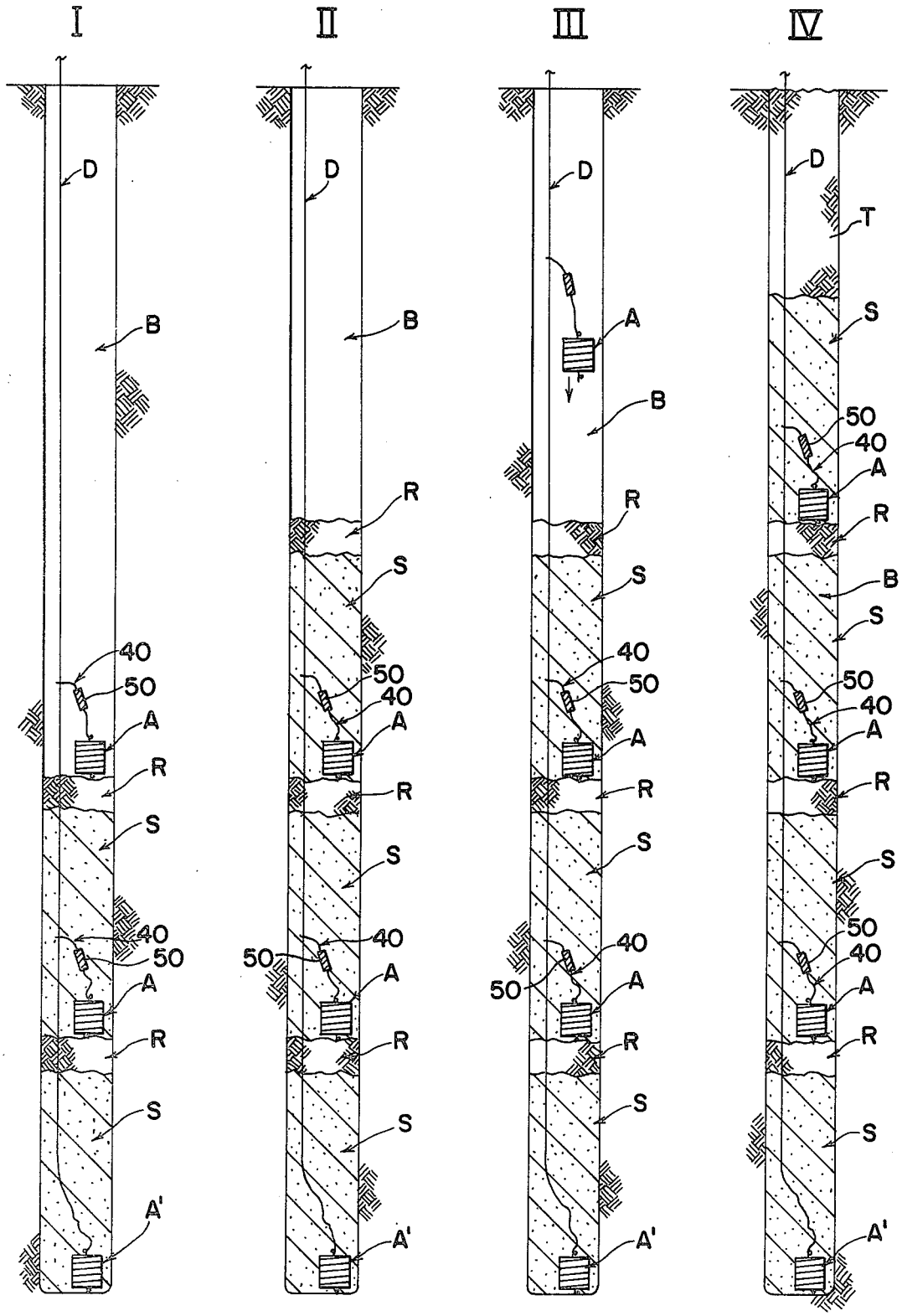
FIG. 3 is a series of views showing the sequence of charging a borehole with a delay primer, as shown in FIG. 1.

Delay primers A can be used to provide a series of spaced explosions in borehole B, as shown graphically in FIG. 3. In this figure, a first primer A′, which is not a time delay primer is connected to the end of down line D and the down line is fed or dropped into borehole B with this primer. Thereafter, explosive material S is charged around the first primer A′. A stem of earth forming barrier R is packed above explosive material S and a delay primer A, constructed in accordance with the present invention, is dropped into the borehole as shown in graph I of FIG. 3. Thereafter, a second charge of explosive material S is placed around primer A and a stem or barrier R is placed over this explosive material to insulate it from the next charge of explosive material. Thereafter, a second primer A is assembled onto down line D and dropped into the borehole as shown in graph I. This process is continued as shown in graphs II, III and IV until a series of explosive charges S are provided, each of which has a different time delay factor or value built into its time element 40. Consequently, as shown in FIG. 3, each of the successive explosive charges S can be detonated in time sequence. The sequence is determined by the cartridge selection in detonating delay element 40.

Figure 3A:
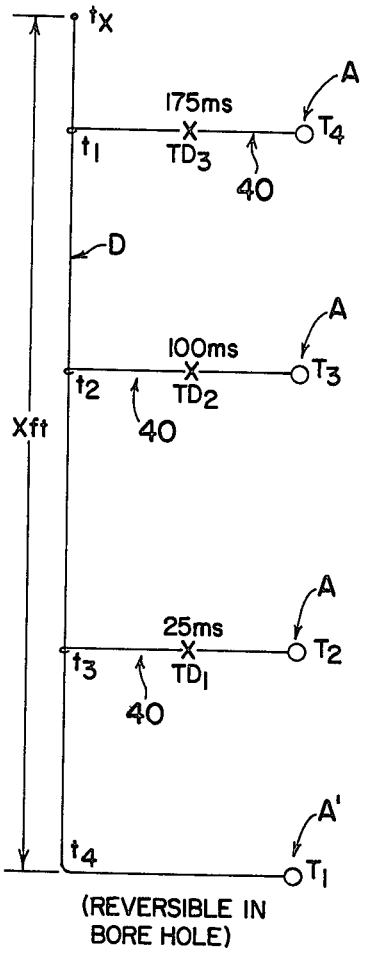
FIG. 3A is a schematic chart showing the time delay principles employed in the charging method best shown in FIG. 3; and, FIG. 4 is an enlarged cross-sectional view showing a modification of the preferred embodiment illustrated in FIG. 1.

Referring now to FIG. 3A, a timing graph or time layout plan used in one embodiment of the present invention is illustrated. In this embodiment, the time delay of a primer at $T_2$ is 25 ms. Primer A at $T_3$ has an illustrated time delay of 100 ms and a primer A at $T_4$ has an illustrated time delay of 175 ms. Thus, with instantaneous detonation of down line 10, the primers are detonated in sequence. The first time spacing between $T_1$ and $T_2$ is approximately 25 ms. The other time spacings are 75 ms. Thus, within 175 ms after detonation of cord 10 by trunk line C, all explosive charges within borehole B are detonated. There has been no instantaneous detonation of the total borehole; therefore, regulations regarding the amount of material exploded within a given distance from an inhabited building or other structure is satisfied by selecting the amount of explosive material in the respective charges and by selecting the time delay between detonation of the axially spaced charges. In practice, the time delay between successive detonations is at least 8 ms and the time spacing is generally less than time spacing used in FIG. 3A, which is provided for illustrative purposes only. The illustrated embodiment is used as an example because standard somewhat inexpensive time delay devices are provided with the illustrated time delay values. As is common knowledge, the time in milliseconds required to detonate along a standard detonating cord is less than a value obtained by dividing the length of the cord by 20. This value is set forth in FIG. 3A. Since this value is extremely small compared to the time delays used in the field and as illustrated in FIG. 3, the delay in cord 10 can be disregarded.

Figure 4:
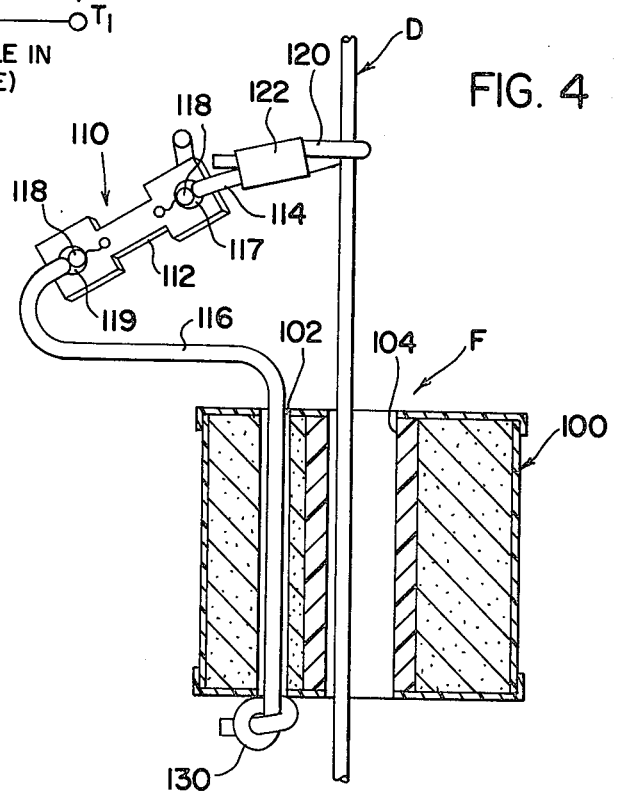

Referring now to FIG. 4, a modification of the preferred embodiment is illustrated. In this modification, the delay primer unit F includes a cast primer 100 having a first bore 102 and a center barrier sleeve 104 for isolating the primer from down line D. A time delay element 110 is formed by combining a standard time delay unit 112 connected to first and second lengths of detonating cord 114, 116, respectively, by pins 118 in holes 117, 119. This type of time delay unit is well known in the art and is generally produced by DuPont Company of Wilmington, Delaware. First length 114 is looped around down line D to form a loop 120 and is held together by an appropriate clip 122. Length 116 is passed through bore 102 and secured in position by a lower knot 130. An upper knot may also be used. Unit F provides a delay primer wherein the loop 120 is not fixed in position with respect to the connection with bore 102. Thus, no carrier or other unit is used to hold the time delay element and primer in position as it slides axially along a down line. It is appreciated that various other arrangements could be used for providing a flexible time delay connection between a primer which is insulated from the down line and the down line itself so that the primer can be positioned axially along the down line with a sliding connection created by the time delay element itself. The preferred embodiment and the modification are shown as examples of this basic concept to which the present invention is directed. For instance, cord length 114 could be omitted by sliding unit 112 on down line D with the down line passing through hole 117. As can be seen the time delay connection between primer 10 and cord D forms the support and guide arrangement for movable delay primer unit A. Primer unit F uses this concept; however, down line D passes through primer 100.

Having thus defined the invention, it is claimed:

1. A delay primer unit for detonating an explosive material in a borehole with a detonating cord down line extending into said borehole, said primer unit comprising: an explosive element capable of detonating said explosive material upon being detonated; an elongated, generally flexible time delay detonating means for connecting said explosive element and said down line, said detonating means forming the only connection between said explosive element and said down line and including first and second mutually movable ends at least one of which is formed from a length of detonating cord and a detonation time delaying element between said mutually movable ends; first coupling means for slidably securing said first end in detonation transfer relationship with said down line whereby said first end can slide along said down line; second coupling means for securing said second end in detonation relationship with said explosive element; and, detonation insulating means for preventing detonation of said explosive element directly by detonation of said down line, said insulating means includes a detonation insulating barrier means supported on said explosive element.

2. A delay primer unit as defined in claim 1, wherein said time delaying element is a time delay cartridge.

3. A delay primer unit as defined in claim 1 wherein said length of detonating cord forms said first movable end and said first coupling means includes means for holding said length of detonating cord looped around said down line.

4. A delay primer unit as defined in claim 1 wherein said length of detonating cord forms said second movable end and said second coupling means includes a bore extending through said explosive element for receiving said length of detonating cord and means for securing said length of detonation cord in said bore.

5. A delay primer unit for detonating an explosive material in a borehole with a detonating cord down line extending into said borehole, said unit comprising: an explosive element capable of detonating said explosive material upon being detonated; a barrier means surrounding said element for preventing direct detonation of said explosive element by said down line; and an elongated, flexible time delay detonation element having a first end slidably looped around said down line, a second end extending into said explosive element and generally movable with respect to said first end, said flexible time delay detonation element forming the only connection between said explosive element and said down line and including a time delay element connected to first and second lengths of detonating cord and said first end is formed by said first length and said second end is formed by said second length.

6. A method of charging a borehole with an explosive material which is not detonated by a selected detonating cord but is detonated by a primer element susceptible to detonation by said selected detonating cord, said method comprising the steps of:

(a) inserting said selected detonating cord into said borehole;
(b) placing a charge of said explosive material in said borehole at a selected position therein;
(c) providing a time delay element having first and second detonating cord ends;
(d) slidably looping said first cord end around said down line;
(e) coupling said second cord end into said primer so that said primer is freely movable with respect to said first end and said down line; and,
(f) moving said primer into said borehole to said selected position.

7. A method of priming a selected area of a borehole having a detonating cord down line extending into the same for delayed explosion of an explosive material in said area, said method comprises the steps of:

(a) providing a detonation time delay device having a first detonation input section, a second output section and detonation from said input section to said output section;
(b) inserting said output section into a primer capable of being detonated by said output section and capable of detonating said explosive material;
(c) slidably looping said input section around said down line;
(d) moving said primer into said borehole while being connected to said down line only by said time delay device.

* * * * *